United States Patent [19]

Seto et al.

[11] Patent Number: 4,895,633

[45] Date of Patent: Jan. 23, 1990

[54] METHOD AND APPARATUS FOR MOLTEN SALT ELECTROPLATING OF STEEL

[75] Inventors: Hirohisa Seto; Atsuyoshi Shibuya; Junichi Uchida; Toshio Nakamori, all of Amagasaki; Hirotaka Nakabayashi, Osaka; Kenichi Yanagi, Hiroshima; Yukio Kanda, Hiroshima; Junkichi Yoneda, Hiroshima; Katsufuma Hidaka, Hiroshima; Yoshio Shimozato, Hiroshima; Yuuji Furuzawa, Hiroshima; Hajime Shimasaki, Hiroshima; Toshio Taguchi, Hiroshima, all of Japan

[73] Assignees: Sumitomo Metal Industries, Ltd., Osaka; Mitsubishi Jukogyo Kabushiki Kaisha, Tokyo, both of Japan

[21] Appl. No.: 202,048

[22] Filed: Jun. 3, 1988

[51] Int. Cl.[4] ..... C25D 17/00

[52] U.S. Cl. ..... 204/207; 204/210

[58] Field of Search ..... 204/207, 210

[56] References Cited

U.S. PATENT DOCUMENTS

| | | | |
|---|---|---|---|
| 3,007,854 | 11/1961 | Smith | 204/210 |
| 3,136,709 | 6/1964 | Smith | 204/210 |
| 3,167,403 | 1/1965 | Smith et al. | 428/653 |
| 3,226,315 | 12/1965 | Smith et al. | 204/206 |

FOREIGN PATENT DOCUMENTS

| | | |
|---|---|---|
| 1300414 | 7/1969 | European Pat. Off. . |
| 699706 | 10/1978 | India . |

*Primary Examiner*—T. M. Tufariello

*Attorney, Agent, or Firm*—Burns, Doane, Swecker & Mathis

[57] ABSTRACT

A method and apparatus for molten salt electroplating a steel member are disclosed, in which the surface of the steel member is activated by anodic treatment and the molten salt electroplating is performed on the activated surface of said steel member.

10 Claims, 10 Drawing Sheets

METHOD AND APPARATUS FOR MOLTEN SALT ELECTROPLATING OF STEEL

BACKGROUND OF THE INVENTION

This invention relates to a method and an apparatus for molten salt electroplating of steel members. More particularly, it relates to a method and an apparatus for molten salt electroplating whereby A1 plating having superior adhesion to a base metal can be formed.

Up to the present time, although various methods of forming A1 plating on steel members (steel strip, steel sheet, steel wire, etc.) by molten salt electroplating have been known, these methods have been put to almost no actual use.

An example of a conventional molten salt electroplating apparatus for forming A1 plating is illustrated in FIG. 1. This example will be explained for the case in which the steel member being electroplated is a steel strip.

As shown in this figure, the front end of a steel strip 2 which is unwound from a pay-off reel 1 is welded to the rear end of the previous steel strip by a welding machine 3, after which it passes through a looper 4 and is sent to a pretreatment apparatus 5. Here, it is subjected to necessary pretreatments such as degreasing and preheating prior to electroplating. Next, its surface is plated in an electroplating tank 6, after which it is washed in a washing tank 7 and then dried in a drier 8. It then passes through a looper 9 and a shearing machine 10 and is wound onto a tension reel 11.

The electroplating tank 6 is filled with an electroplating solution 12. Plating is formed on the surface of the steel strip 2 as it passes between electrodes 13 which are disposed in the electroplating solution.

Electroplating using the above-described method has not been performed industrially to any great extent for the following reasons.

At present, industrial electroplating is largely electrocrystallization from an aqueous solution. While there are roughly 30 different types of metals which can be electroplated by electrocrystallization from an aqueous solution, there are approximately only 10 types on which such electroplating is actually performed. Accordingly, the other types must be plated using a nonaqueous solution or a molten salt bath. While electrocrystallization in a molten salt bath can be performed on almost every metal, the condition of the plating is generally poor with the deposited metal being in the form of dendrite crystals or a powder, so the adhesion of the plating to the base metal is poor. Therefore, it is difficult to obtain smooth plating by molten salt electroplating, and furthermore, molten salt electroplating is difficult to perform.

The surface of a steel member to be plated is activated by wet treatments such as washing in acid followed by washing with water. Then, prior to electroplating, it is necessary to dry the steel member because if any water is introduced into the molten salt electroplating bath, the bath will rapidly deteriorate. There must be strict control of both moisture and the atmosphere of an electroplating line. However, if drying is performed by heating to a high temperature (such as 180° C.) in air, the adhesion of the plating which is subsequently formed by molten salt electroplating greatly decreases.

In addition, although salt adhering to the surface of a steel member which was plated is washed off in the washing tank 7 of FIG. 1, when the salt which is used in A1 plating is washed off using water, the salt reacts with the water and can not be reused in the electroplating bath. Accordingly, salt which adheres to the steel strip 2 and is removed from the electroplating tank 6 ends up being discarded, and the running costs of a steel strip electroplating line of this type are increased. Furthermore, as the waste water from the washing tank 7 contains a large amount of salt, it is necessary to employ large-capacity water treatment equipment.

Another problem is that molten salt vapor is present in the empty space within the electroplating tank 6 above the electroplating solution 12. If this vapor were to leak out of the electroplating tank 6, it would be harmful to humans, so the inside of the electroplating tank 6 must be ventilated and kept at a pressure below atmosphere pressure. The gas which is exhausted from the electroplating tank 6 is passed through a spray tower 14 and after gaseous salt in the exhaust gas is removed, the gas is exhausted into the atmosphere by an exhaust fan 15.

If the gaseous salt does not react with water, the salt can be recovered by drying the treatment liquid used for cleaning the exhaust gas. However, if the gaseous salt reacts with water, the salt can no longer be recovered. Therefore, the salt which is removed from the electroplating tank 6 as exhaust gas ends up being discarded, and the running costs of this method are further increased.

Furthermore, an increase in the amount of salt in the treatment liquid produces a need for larger water treatment equipment and leads to an increase in treatment costs.

SUMMARY OF THE INVENTION

As a result of various investigations concerning the reason why molten salt electroplating has not been hitherto practiced, the present inventors found that the cause of the decrease in the adhesion of plating is that when a steel member is dried by heating prior to electroplating, an oxide film is formed on the surface of the steel member and adsorption of oxygen takes place.

In order to prevent the formation of such an oxide film and the adsorption of oxygen, it is necessary to perform the drying of a steel member at a low temperature after washing the member with water, and it is necessary to perform preheating in an inactive gas atmosphere. Furthermore, if an oxide film is formed on a steel member, it must be removed by some means.

One possible method of activating the surface of a steel member prior to molten salt electroplating is anodic treatment in a molten salt treatment bath. In this method, the steel member to be treated is used as an anode, electrolysis is performed, and the dissolution of the surface of the steel member is promoted.

However, the degree of oxidation of the surface of a steel member varies depending on the drying conditions after washing with water, and the anodic treatment conditions must be altered in accordance with the degree of oxidation, as a result of which operations become complicated.

Moreover, as the degree of surface oxidation of a steel member depends on the drying conditions, if anodic treatment is performed under constant conditions, the degree of surface activation will in some cases be inadequate, while in other cases, anodic electroylysis may progress too far, and $Fe^{2+}$ions will elute into the molten salt treatment bath. These iron ions will accumulate in the treatment solution, and as some of the treatment solution will adhere to the steel member when it is transferred to the electroplating bath, iron ions will be introduced into the electroplating bath together with the steel. As a result, the iron content of the electroplating bath will increase, and as it increases, iron will be end up being contained in the plating and the quality of the plating will decrease.

Accordingly, it is an object of the present invention to provide a molten salt electroplating method in which wet pretreatment is performed on a steel member, and then the steel member, which has a water film adhering thereto, is subjected to molten salt electroplating, wherein the drying and preheating conditions are controlled so as to obtain a plating of constant quality.

Another object of the present invention is to provide a molten salt electroplating method and apparatus for forming A1 plating which can be employed industrially.

Upon performing further investigations aimed at finding an industrially useful process for molten salt electroplating, the present inventors made the following discoveries.

(1) There are certain necessary heating and drying conditions when performing drying and/or preheating subsequent to washing with water.

(2) The necessary conditions for anodic treatment of a steel member are determined by the degree of surface oxidation of the steel member, which depends upon the maximum heating temperature and the heating rate during drying and/or preheating in the atmosphere.

(3) If anodic treatment is performed in a molten salt electroplating bath, elemental aluminum or an alloy thereof is deposited on the counter electrode, and operation for long periods can not be performed. However, if an anodic treatment bath has a composition of 50–54 mole % of $A1C1_3$ and also contains a chloride of an alkali metal, and still more preferably, if A1 or Ti is used for the counter electrode, electrodeposition of a metal or alloy onto the counter electrode is prevented, and stable operation for long periods can be performed.

Thus, in a broad sense, the present invention is a molten salt electroplating method comprising the steps of cleaning the surface of a steel member, drying and preheating the steel member subsequent to cleaning, performing surface activation treatment, preferably in the form of anodic treatment, and then performing molten salt electroplating on the activated surface of the steel member.

In a preferred mode of the present invention, a molten salt electroplating method comprises a cleaning step including initial cleaning, such as degreasing and washing with acid, followed by washing with water; a drying step; a preheating step; an activation step; and a molten salt electroplating step, wherein the drying or preheating conditions during the drying step and/or the preheating step which are performed in the atmosphere are given by the following formula when the temperature which is reached by the steel member exceeds 100° C.:

$$Tm \leqq (44.4)\log R + 120$$

wherein

Tm = maximum temperature (°C.) reached by the steel member in the atmosphere, and R = average rate of temperature increase (°C./sec) of the steel member in the atmosphere during the drying step and the preheating step after washing with water.

In the present invention, there is no restriction on Tm when it is 100° C. or below, since at a normal line speed, if Tm does not exceed 100° C., the surface of a steel member being plated does not undergo excessive oxidation, so there is no need to limit Tm.

The above-mentioned average rate of temperature increase is the average rate in the temperature range above 70° C. However, if water washing is performed at a temperature of greater than 70° C., the average rate of temperature increase is the rate in the temperature range above the water washing temperature.

In accordance with a different mode of the present invention, the activation step is performed by anodic treatment, the degree of oxidation of the surface of the steel member is detected in the drying step and/or the heating step, and the anodic treatment conditions in a molten salt bath in the activation step are determined based on the detected degree of oxidation.

The degree of oxidation of the surface of the steel member is determined by measuring the temperature of the surface, or by measuring a temperature corresponding to the surface temperature, such as the temperature of the atmosphere in which the steel member is disposed or the temperature of a gas which is blwon at the steel member. In accordance with a specific mode, the line speed is assumed to be constant, first the surface temperature of the steel member is measured to determine the maximum temperature which is reached by the steel member and the rate of temperature increase, and based on these values, the electric charge during anodic treatment is regulated so as to remove only the surface oxide film as completely as possible. When the preheating step is performed in an inactive gas atmosphere, the surface of the steel will undergo no further oxidation, so the temperature of the steel member immediately prior to the preheating step can be measured and used as the maximum temperature reached by the steel member.

In accordance with another preferred mode of the present invention, the drying step and/or the preheating step are performed in the atmosphere, and the degree of oxidation is detected based on the highest temperature reached in these steps and the rate of temperature increase up to the highest temperature.

One characteristic of the present invention is that a steel member is subjected to anodic treatment and surface activation is performed prior to molten salt electroplating of the steel member. The molten salt bath which is used for the anodic treatment may be a separate bath from the molten salt bath which is used for electroplating. When A1 plating is formed by molten salt electroplating, the anodic treatment can be effectively performed in a molten salt bath comprising $A1C1_3$ and a chloride of an alkali metal. Preferably, the molten salt bath contains 50–54 mole % of $A1C1_3$.

In accordance with yet another preferred mode of the present invention, the counter electrode which is employed for the anodic treatment is made of A1, Ti, or an alloy of one of these metals, whereby electrodeposition onto the counter electrode can be prevented and stable treatment can be performed for long periods of time. Furthermore, the anodic treatment can be performed in a temperature range which is at most 70° C. above the molting point of the molten salt.

As already stated, when performing anodic treatment, the dissolution of Fe ions is unavoidable. Accordingly, in accordance with another mode of the present invention, a metal having a greater tendency to ionize than iron is added to the anodic treatment bath, as a result of which the iron ions are reduced and elemental iron precipitates from the anodic treatment bath.

Namely, a steel member is immersed in a molten salt bath for anodic treatment, a cathode plate is suspended in the bath so as to confront the steel member, and a current is passed through the steel member and the cathode plate, with the steel member acting as the anode, as a result of which iron is dissolved from the surface of the steel member. The iron ions which are produced by reducing the surface of the steel member and activating it are immdiately converted into elemental iron powder. Therefore, by adding a metal powder having a greater tendency to ionize than iron to the anodic treatment bath, no iron ions are included in that portion of the treatment solution which adheres to the steel member.

The present invention is also a molten salt electroplating apparatus comprising an activation means for performing anodic treatment of a steel member in a molten salt bath and activating the surface of a steel member, a molten salt electroplating means for forming plating on the steel member whose surface has been activated in the above manner, and an iron ion removing means which communicates with the molten salt bath of the activation means and which is filled with metal particles having a greater tendency to ionize than iron.

Namely, in the present invention, iron ions which are formed in the molten salt bath of the activation means are led to the iron ion removal means by an external path, and in the iron ion removal means, they are contacted with the metal particles having a greater tendency to ionize than iron and are made to precipitate.

The iron which is precipitated by the iron ion removal means is collected and removed by a means such as a magnetic separator, and the solution from which the iron has been removed is returned to the activation means.

Therefore, the molten salt bath of the activation means is not deteriorated by iron ions, and the steel member is not accompanied by iron ions.

The cleaning step of the present invention includes pretreatments such as degreasing, washing with acid (including electrolysis), and washing with water.

The most typical plating metal for use in the present invention is A1, but Zr, Ti, and alloys such as A1-Mn and A1-Ti can also be employed.

Furthermore, "steel member" as used in the present invention refers to steel strip, steel sheet, steel plate, steel wire, and the like.

After electroplating, a small amount of salt inevitably remains on the plated surface.

Accordingly, in accordance with one mode of the present invention, a cleaning tank containing a solvent is provided to the rear of an electroplating tank. In the cleaning tank, a solvent which does not dissolve the salt is sprayed at the surface of the steel member and the salt is washed off. After washing, the salt is separated from the mixture of solvent and salt by gravity separation, and both the salt and the solvent are reused.

Thus, the present invention also resides in a molten salt electroplating method comprising the steps of continuously electroplating the surface of a steel member with a molten salt electroplating bath using a continuous electroplating apparatus, washing off the salt which adhered to the surface of the steel member by spraying the surface of the steel member with a solvent which has a boiling point which is lower than the temperature of the steel member immediately after electroplating and which does not dissolve the salt, and separating the salt from the solvent using gravity separation after washing.

The solvent which is used in the present invention has a boiling point which is lower than the temperature of the steel member immediately after electroplating. In addition, it is necessary that the solvent be in a liquid state when it is sprayed from a nozzle. Thus, the solvent preferably has a boiling point which is higher than room temperature, but lower than the temperature of the steel member.

When a solvent having a boiling point which is lower than the temperature of the steel member immediately after electroplating is sprayed at the steel member, as the temperature of the steel member is higher than the boiling point of the solvent, the solvent absorbs heat from the steel member and vaporizes. The volume expansion due to vaporization of the solvent produces a scrubbing effect ad mechanically peels off salt which adheres to the steel surface.

When the salt which is employed to form aluminum plating is, for example, a mixture of aluminum chloride, sodium chloride, and potassium chloride, the salt mixture has a melting point of 90–100° C., and electroplating is performed at a temperature of 150–250° C.

In this case, some examples of solvents which can be used for washing are Freon 113 (Trade name, DuPont Co., Ltd., boiling point: 48° C.), perchloroethylene (boiling point: 121° C.), and tetrachloroethylene (146° C.). If a solvent such as these is sprayed at the surface of a steel member having a temperature of 150°–250° C. immediately after electroplating, the solvent will absorb heat from the steel member and vaporize on the surface of the steel member. The volume expansion caused by the vaporization of the solvent will wash salt off the surface of the steel member.

The salt which is washed off is then mixed with the solvent. When Freon 113 (Trade name, DuPont Co., Ltd.) is used as the solvent, as it has a lower boiling point than the melting point of the salt, the salt which is mixed therein will become a solid. Accordingly, the mixture of the salt and the solvent will be in the form of a solid-liquid mixture, and the two substances can be mechanically separated by a gravity separation method, such as by centrifugation. If perchloroethylene is used as the solvent, the mixture of the salt and the solvent will be a liquid-liquid mixture, but in this case as well, the two substances can be separated by the same type of gravity separation method.

In the present invention, molten salts other than aluminum chloride and sodium chloride can be used, and solvents for washing other than those named above can also be used, such as trichloroethylene, carbon tetrachloride, benzene, and toluene.

Furthermore, when using water to wash the exhaust gas from the electroplating tank, a water-soluble salt can not easily be recovered. Accordingly, in a preferred mode of the present invention, exhaust gas from the electroplating tank is cooled in a cooler, gaseous salt within the exhaust gas is changed from a gas into a fume or a mist, and the fume or mist is then recovered by being passed through a dust collector such as a filter or an electrostatic precipitator.

In the above-described mode of the present invention, the exhaust gas containing gaseous salt is first indirectly cooled in a cooler. There, the gaseous salt in the exhaust gas, which has a low vapor pressure, can be made to exist as a gas, and excess salt will agglomerate to form a fume or mist and will float in the exhaust gas.

The fume or the mist can be recovered using various types of dust collectors, such as a filter or an electrostatic precipitator, in accordance with the particle diameter.

Therefore, after cooling the exhaust gas and forming a fume or a mist, the salt can be directly recovered using a dust collector.

It is also possible to supply the exhaust gas from the electroplating tank to a separate molten salt tank and pass the exhaust gas through the molten salt, whereby the gaseous salt in the exhaust gas is absorbed.

For example, when forming aluminum plating using a molten salt which is a mixture of aluminum chloride and sodium chloride, if the proportion of aluminum chloride in the molten salt is 70 mole %, when the temperature of the molten salt is 200° C., the partial vapor pressure of the aluminum chloride at the liquid surface is approximately 200 mm of Hg. However, when the proportion of aluminum chloride is 50 mole %, at a temperature of 120° C., its partial vapor pressure falls to about 1 mm of Hg.

Accordingly, if exhaust gas containing a gaseous salt with a partial pressure of 200 mm of Hg is passed through a low-concentration, low-temperature molten salt bath like the one just described, almost all of the gaseous salt in the exhaust gas will be absorbed by the molten salt bath.

After adjusting the salt concentration of the molten salt bath which absorbed the gaseous salt from the exhaust gas, the molten salt can be transferred to the electroplating tank and reused as an electroplating solution.

DESCRIPTION OF THE PREFERRED EMBODIMENTS

Figure 1:
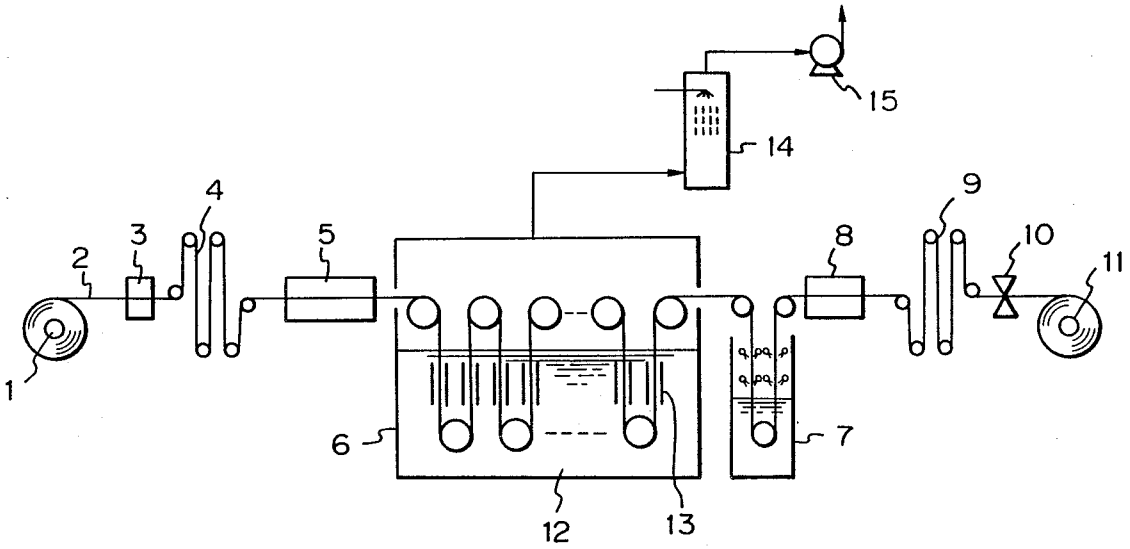
FIG. 1 is a schematic view of a conventional molten salt electroplating apparatus for forming A1 plating.

The present invention will now be described in greater detail while referring to the accompanying drawings, in which the same reference numerals indicate the same or corresponding parts.

Figure 2:
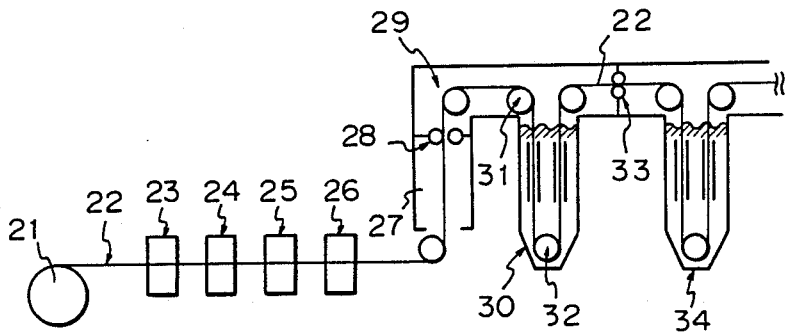
FIG. 2 is a schematic view of an embodiment of a molten salt electroplating apparatus in accordance with the present invention.

FIG. 2 is a schematic view of an embodiment of a molten salt electroplating apparatus in accordance with the present invention. In the figure, steel strip is used as a steel member.

In its broadest form, a molten salt electroplating apparatus in accordance with this invention comprises means for drying and preheating a steel member, anodic treatment means for activating the surface of the steel member after preheating, and electroplating means with an unimmersed anode for electroplating the steel member after activation.

In FIG. 2, steel strip 22 which is unwound from a pay-off reel 21 passes through a degreasing tank 23, a water washing tank 24, an acid washing tank 25, and another water washing tank 26, and in these tanks 23–26 a cleaning step is performed. The steel strip 22 then continuously passes through a drying chamber 27 which constitutes a drying means, and a drying step is performed.

In the drying chamber 27, first a heated gas such as heated air is blown at the steel strip 22 to heat and dry it. Next, a preheating step is performed in which the steel strip 22 enters an inert gas atmosphere 29 which is sealed off from the outside by a seal roller 28 and is preheated. Next, the steel strip 22 is sent to an anodic treatment tank 30 in the same inert gas atmosphere 29, and in the treatment tank 30, which contains a molten salt treatment bath comprising, for example, $A1C1_3$ and a chloride of an alkali metal, anodic treatment is performed. The anodic treatment tank 30 constitutes anodic treatment means for performing surface activation.

In FIG. 2, element number 31 is a conductor roller for anodic treatment, and element number 32 is a sink roller.

The steel strip 22 which is pretreated in this manner passes through partitioning rollers 33 and leaves the inert gas atmosphere 29. It then enters a molten salt electroplating tank 34 and prescribed electroplating is performed. Preferably, the electroplating tank 34 is contained in an inert gas atmosphere like atmosphere 29. The illustrated electrodes are immersed electrodes, but as will be explained further on, unimmersed electrodes are preferable.

In accordance with the present invention, the conditions for drying and preheating which are performed in the atmosphere, i.e., in air are defined by the following equation when the surface temperature of the steel member is greater than 100° C.:

$$Tm \leqq (44.4)\log R + 120$$

wherein

Tm = maximum temperature reached by the steel member in the atmosphere (°C.), and R = average rate of temperature increase of the steel member in the atmosphere during drying and heating after water washing (°C/sec). Specifically, it is the average rate of temperature increase between the temperature during water washing, such as the temperature of the washing water, and the maximum temperature reached by the steel member.

As already stated, the drying and preheating conditions are preferably determined based on the maximum temperature reached by the steel strip 22 prior to the preheating step in the inert gas atmosphere 29 and the rate of temperature increase up to that point. When the rate of temperature increase is large, the maximum temperature which is reached can be increased accordingly. On the other hand, when the rate of temperature increase is small, heating requires a long time, so the maximum temperature which is reached must be set at a lower value. In other words, the amount of thermal energy used for heating in the atmosphere above 100° C. is controlled so as to be constant so that the degree of oxidation of the surface of the steel member will be constant.

Thus, according to the present invention, anodic treatment in the activation step is performed to the minimum extent necessary and in some cases may be omitted. As a result, continuous treatment can be efficiently performed.

The anodic treatment conditions in the anodic treatment tank 30 (the electrolysis voltage, the current, and the total electric charge) are determined by the weight and the properties of the oxide film which is formed on the surface of the steel member during drying by heating. In the example illustrated in FIG. 2, the anodic treatment conditions can be determined based on the maximum temperature reached by the steel strip 22 just before entering the inert gas atmosphere 29 and the rate of temperature increase up to that temperature.

In this case as well, anodic treatment is performed to the minimum extent necessary, and continuous treatment can be efficiently performed.

If drying is performed in the atmosphere, an oxide film is formed on the steel member even at a low temperature of around 80° C. and the adhesion of the plating layer is decreased. However, according to the present invention, pretreatment in the form of anodic treatment is performed on a steel member and the surface of the steel member is activated. As a result, plating having good adhesion can be formed. In the past, when anodic treatment was performed in a plating bath, metal deposited on the counter electrode and continuous treatment for long periods was difficult to perform. However, in a preferred mode of the present invention, anodic treatment is performed in a bath containing 50–54 mole % of $AlCl_3$ and a remainder of a chloride of an alkali metal. Therefore, powdery electrodeposition takes place, almost no plating takes place, and continuous anodic treatment can be performed.

If the concentration of $AlCl_3$ in the molten salt anodic treatment bath is less than 50 mole %, the melting point of the treatment bath becomes undesirably high. On the other hand, if the concentration exceeds 54 mole %, treatment bath conditions become favorable for electrocrystallization, electrodeposition is promoted, and continuous operation can not be performed.

In this case, it was found that if Al, Ti, or alloys of these metals are used as the material for the counter electrode, it becomes difficult for plating to adhere to the counter electrode.

After performing anodic treatment in the above-described treatment bath, if molten salt electroplating of plating such as Al plating is immediately performed, the adhesion between the plating layer and the base metal is extremely good.

A total electric charge of 20 coulombs/$dm^2$ is adequate for the anodic treatment. However, a smaller charge may be used, depending on the drying conditions, i.e., the degree of oxidation of the surface of the steel plate.

Figure 3:
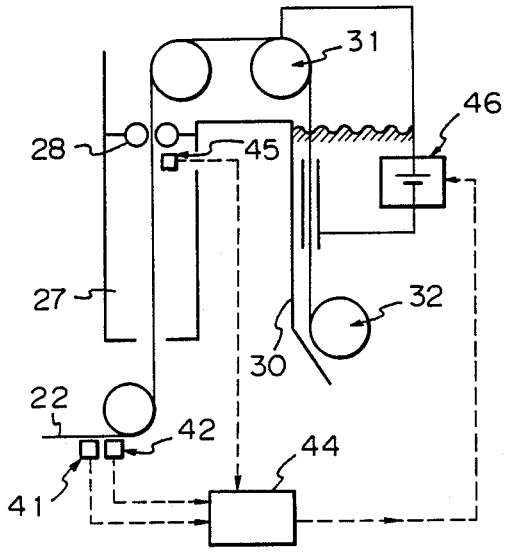
FIG. 3 is an enlarged view of a portion of FIG. 2.

FIG. 3 is an enlarged view of a portion of FIG. 2. It includes a block diagram of a mechanism for detecting the degree of oxidation of the surface of the steel strip and controlling the anodic treatment conditions. In this embodiment, the maximum temperature reached by the steel strip just prior to the preheating step and the rate of temperature increase up to that time are measured and the degree of oxidation is calculated.

In FIG. 3, the speed at which the steel strip 22 is conveyed is detected by a speed detector 41, such as a contact-type mechanical speed detector. The speed of the steel strip 22 may also be determined by measuring the rotational speed of the motor of a suitable drive roller. The speed of the steel strip may be measured at a single location.

Next, the steel strip 22 is introduced into a drying chamber 27, but before it enters the drying chamber 27, its temperature is measured by a temperature measuring device 42 such as a radiation thermometer. Between the washing step and the drying step, there is no externally-supplied heat, so the temperature during the washing step, i.e., the temperature of the washing water, may be used as the temperature of the steel strip prior to its entering the drying chamber 27.

The speed and temperature data which are obtained are sent to a computing and control unit 44 which is equipped with an interface. The temperature of the steel strip on the exit side of the drying chamber 27 is measured by a temperature detector 45, and the signal from the temperature detector 45 is likewise sent to the computing and control unit 44. The temperature which is measured at this point is the maximum temperature reached by the steel strip 22 during heating and drying in the atmosphere. Based on this value, the maximum temperature reached by the steel strip 22 and the rate of temperature increase up to this point are detected. Based on this data, the value of the electrolysis current for the anodic treatment tank 30 is determined, and this current is supplied via a rectifier 46.

The detection of the degree of oxidation of the surface of the steel strip can be performed by measurement at a single suitable point.

In this manner, according to the present invention, the degree of heating of a steel strip in the atmosphere is determined from the change in its surface temperature, and on the basis of this heating history, the anodic treatment conditions, and particularly the total electric charge which is employed, are determined. As a result, the oxide film on the surface of the steel strip can be adequately dissolved.

Figure 4:
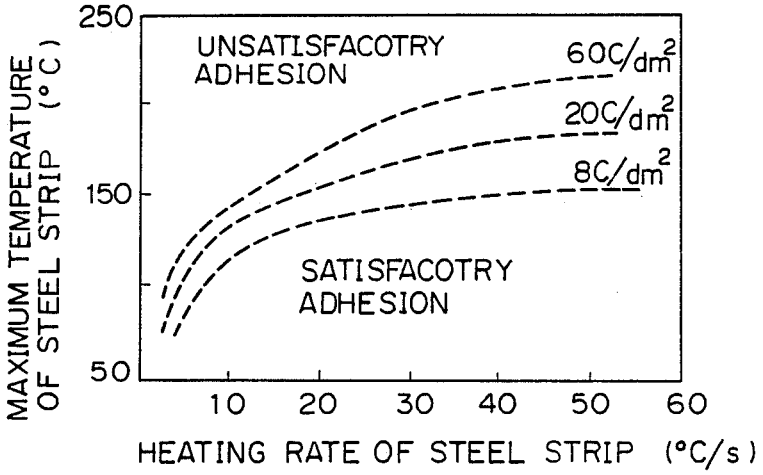
FIG. 4 is a graph showing the effects of the rate of temperature increase of a steel strip and the maximum temperature reached by the steel strip on the adhesion of plating.

FIG. 4 is a graph showing the effects of the maximum temperature and the rate of temperature increase on the adhesion of plating formed by molten salt electrodeposition using the apparatus of FIGS. 2 and 3. The plating material was an Al - 20 % Mn alloy, and it was formed on the surface of cold-rolled steel strip using three different values of total electric charge in accordance with an example to be described further on. From this graph, given a certain maximum temperature and rate of temperature increase of the steel strip, the value of total electric charge (current density x time) necessary to obtain plating with satisfactory adhesion can be found. The plating adhesion was determined by the Dupont impact test, which will be described further on.

Figure 5:
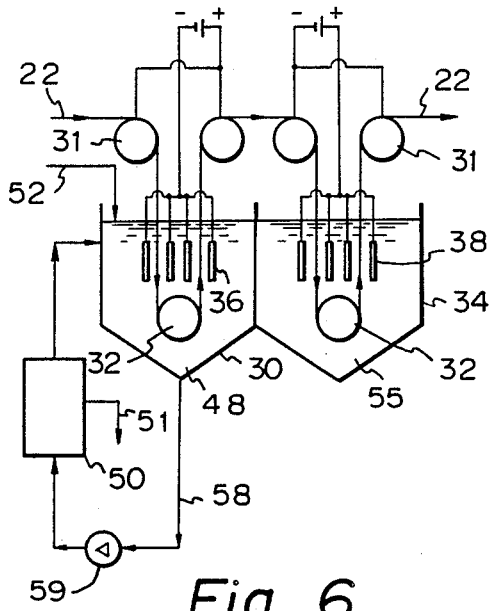
FIG. 5 is an enlarged schematic view of a portion of another embodiment of a molten salt electroplating apparatus of the present invention.

FIG. 5 is an enlarged view of a portion of another embodiment of a molten salt electroplating apparatus of this invention. In this embodiment, a steel strip 22 is continuously fed into an anodic treatment tank 30, and then it is sent to a molten salt electroplating tank 34. The steel strip 22 is subjected to anodic treatment in the anodic treatment tank 30, the oxide film on its surface is removed, and its surface is activated. In FIG. 5, elements numbers 36 and 38 are respectively cathodes and anodes. If a metal powder, such as aluminum powder, which has a greater tendency to ionize than Fe is added to the anodic treatment solution 48 by a supply line 52 and is dispersed in the anodic treatment solution 48 before anodic treatment is performed, even if the steel strip 22 is oxidized by anodic oxidation and Fe ions are formed, the Fe ions will be immediately reduced to form elemental Fe, and almost no Fe ions will be present in the anodic treatment solution 48.

As the amount of Fe powder in the anodic treatment solution 48 will gradually increase, the treatment solution 48 is passed along a circulating path 58 to a metal separator 50 by a pump 59, and elemental Fe is discharged from the metal separator 50 through line 51.

Figure 6:
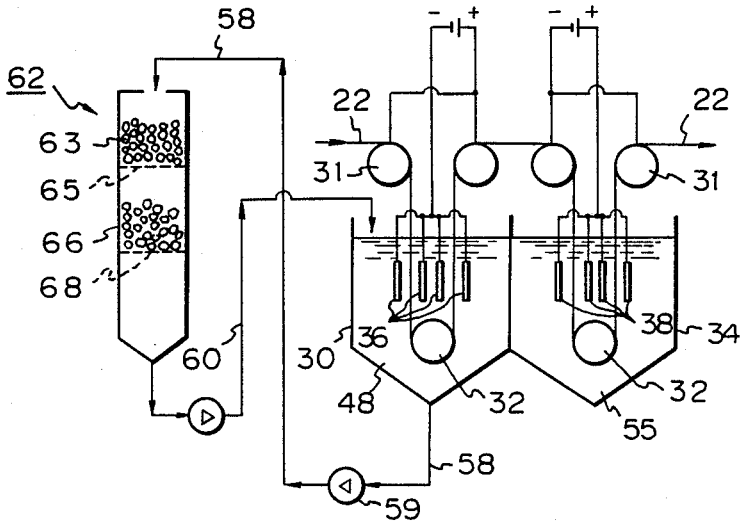
FIG. 6 is an enlarged view of a portion of yet another embodiment of the present invention.

FIG. 6 illustrates a portion of another embodiment of the present invention which employs a different mechanism for removing Fe ions. In this embodiment, the anodic treatment solution 48 is circulated by a pump 59 through a circulation path 58 and is sent to an Fe ion removing mechanism 62. This Fe ion removing mechanism 62 comprises a packed layer 63 of a powder of a metal such as aluminum which has a greater tendency to oxidize than Fe, a screen 65 having a mesh which is finer than the particle diameter of the particles in the packed layer 63, a magnetic separator 66, and a screen 68 having a mesh which is finer than the particles in the magnetic separator 66. Accordingly, Fe ions which are contained in the anodic treatment solution 48 are reduced to form elemental Fe by contact with the packed layer 63 and precipitates as elemental Fe powder. The Fe powder is then adsorbed by the magnetic separator 66 and separated.

Fe ions in the anodic treatment solution 48 can be completely removed by passage through the Fe ion removing mechanism 62. The anodic treatment solution 48 from which Fe ions were removed is then returned to the anodic treatment tank 30 through line 60.

In this embodiment, as Fe ions which are formed during anodic treatment are quickly removed from the anodic treatment solution 48, the amount of Fe ions which adhere to the steel member and are introduced into the molten salt electroplating tank 34 is minimized. Therefore, stable operation over long period is made possible, and plating having good adhesion can be formed.

Figure 7:
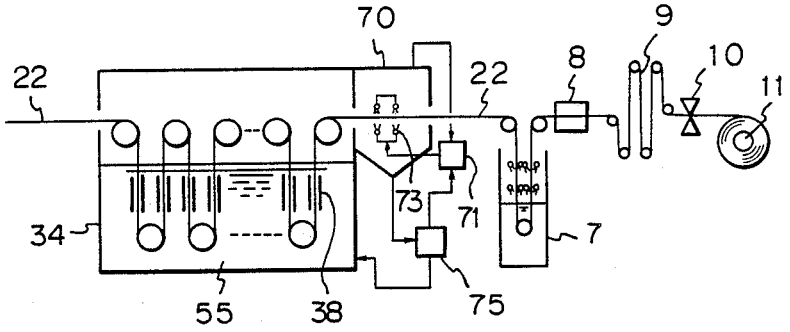
FIG. 7 is a schematic view of a portion of another embodiment of the present invention which is equipped with a molten salt circulating path for a molten salt electroplating tank.

FIG. 7 is a schematic view of a portion of another embodiment which is equipped with a molten salt recovery mechanism for minimizing the amount of molten salt which is removed from the molten salt electroplating tank 34. In FIG. 7, a steel strip 22 which has been subjected to suitable surface activation treatment is subjected to molten salt electroplating in a molten salt electroplating tank 34, after which the steel strip is sent to the above-described molten salt recovery mechanism. In a solvent washing tank 70, the salt is washed off the surface of the steel strip 22 by a solvent. Then, the steel strip 22 is washed with water in a washing tank 7, is dried in a drying chamber 8, passes through a looper 9 and a shearing machine 10, and is wrapped around a tension reel 11.

In this embodiment, the steel strip 22 which enters the solvent washing tank 70 from the electroplating tank 34 is sprayed by nozzles 73 with a solvent which will not dissolve the salt. The solvent is stored in a solvent tank 71 and is kept at room temperature, or else it is heated to a temperature near its boiling point so that it can easily vaporize upon striking the surface of the steel strip 22. The solvent which is sprayed at the surface of the steel strip 22 vaporizes upon striking the surface, and the volume expansion caused by the vaporization produces a scrubbing action which washes off the salt which adheres to the surface of the steel strip 22. The solvent flows down together with the salt into a separator 75. That portion of the solvent which has vaporized is condensed by cooling and is returned to the solvent tank 71. In the separator 75, the salt and the solvent are separated on the basis of the difference in their specific gravities, the salt is returned to the electroplating tank 34, and the solvent is returned to the solvent tank 71.

In the past, the salt which adhered to the surface of a steel strip after electroplating was washed off and discarded, but in accordance with the present invention, the salt can be recovered, and the running cost of electroplating steel strip can be decreased. Furthermore, the load on the washing tank 7 is decreased, so the capacity of waste water treatment equipment can be reduced.

Figure 8:
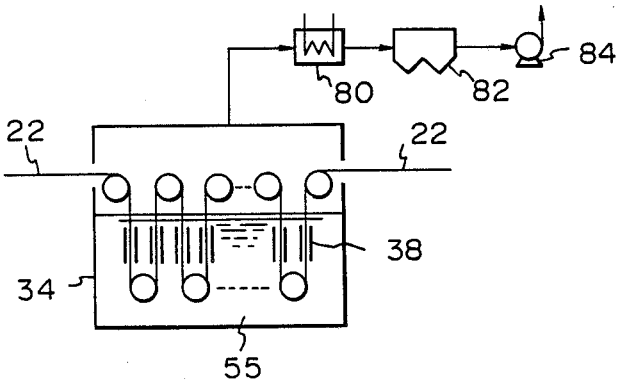
FIG. 8 is a schematic view of a portion of another embodiment of the present invention which is equipped with a mechanism for recovering molten salt from the exhaust gas from a molten salt electroplating tank.

FIG. 8 shows a portion of another embodiment of the present invention which is equipped with a mechanism for recovering molten salt from the exhaust gas of the electroplating tank 34. The electroplating tank 34 is partially filled with a molten salt electroplating solution 55, and a steel strip 22 is electroplated as it passes between electrodes 38 which are disposed in the electroplating solution 55. The space within the electroplating tank 34 above the electroplating solution 55 contains molten salt vapor. In order to prevent this vapor from leaking to the outside, the inside of the electroplating tank 34 is ventilated and kept at a negative pressure.

The exhaust gas from the electroplating tank 34 is cooled in a cooler 80, and the salt becomes a fume or a mist. The exhaust gas is then passed through a dust collector 82 to recover the salt therefrom, and the exhaust gas is then exhausted by an exhaust fan 84.

The operation of this embodiment will be explained in greater detail for the case in which aluminum electroplating is being performed and the molten salt bath is a mixture of aluminum chloride and sodium chloride.

The vapor pressure of aluminum chloride is 0.01 mm of Hg at 20° C., and it is 50 mm of Hg at 150° C. As the inside of the electroplating tank 34 is at least 150° C. during electroplating, aluminum chloride vapor having a partial pressure of at least 50 mm of Hg is present in the gas within the electroplating tank 34. If the exhaust gas containing this salt vapor is cooled to approximately 20° C. in the cooler 80, almost all of the salt vapor will become a fume. This fume has a particle diameter of several microns, and it can be recovered using a filter or an electrostatic precipitator as the dust collector 82.

Figure 9:
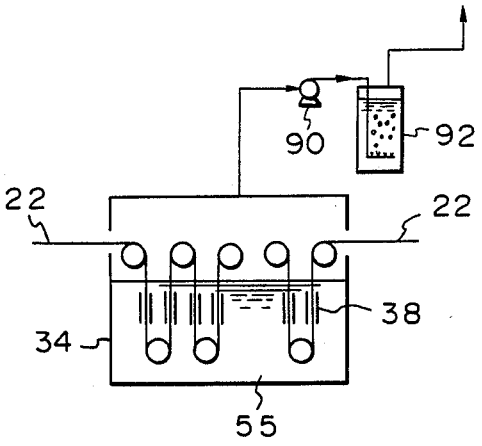
FIG. 9 and FIG. 10 are schematic views of portions of another embodiment having a different type of molten salt recovery mechanism.
Figure 10:
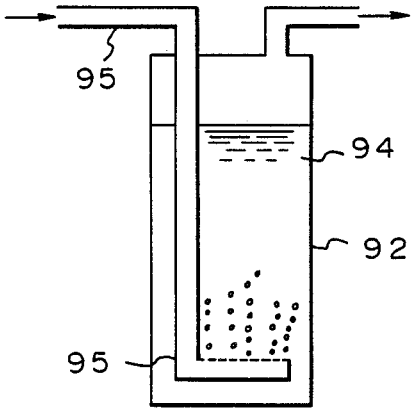

FIGS. 9 and 10 are schematic views of portions of another embodiment of the present invention which is equipped with a different type of mechanism for recovering salt from the exhaust gas from the electroplating tank 34. In this embodiment, exhaust gas from the electroplating tank 34 is lead into a salt absorbing tank 92 by an exhaust fan 90. Here, the salt vapor is removed by absorption and the remaining gas is exhausted.

FIG. 10 illustrates the structure of the salt absorbing tank 92 in greater detail. Molten salt 94 having a low concentration of a component which vaporizes to become gaseous salt (such as a mixture containing 70–50 mole % of $AlCl_3$ and 30–50 mole % of NaCl) is maintained at a low temperature within the absorbing tank 92. Exhaust gas is introduced into the molten salt 94 through an inlet pipe 95 which has small holes formed therein and which is disposed at the bottom of the tank 92. The gaseous salt in the exhaust gas is absorbed by the molten salt 94.

The molten salt which absorbed the gaseous salt is sent to an unillustrated storage tank, and after its temperature is adjusted, it is transferred to the electroplating tank 34 and reused as an electroplating solution 55.

In each of the above-described embodiments, the anodes which are used for electroplating are plate-shaped members. However, a basket-shaped anode chamber of the type which is conventionally used in an electroplating apparatus employing an aqueous electroplating solution can also be used in the present invention. However, as the present invention employs a molten salt electroplating solution, it is preferable to use a basket-shaped anode chamber of the type shown in FIGS. 11 and 12 which has a ceramic-coated panel and therefore has superior durability compared to a conventional basket-shaped anode chamber. A basket-shaped anode chamber of this type can be used either as an immersed electrode or an unimmersed electrode.

Figure 11:
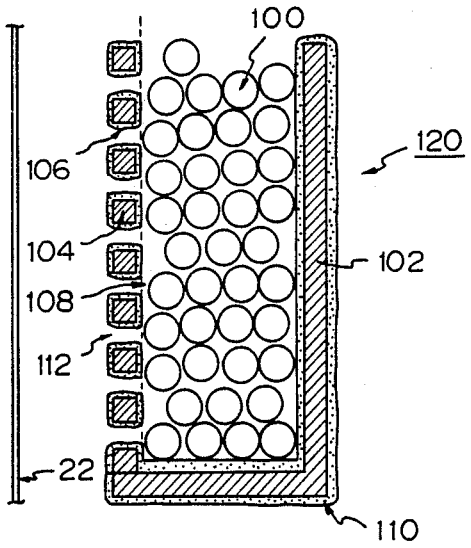
FIG. 11 is a cross-sectional view of a portion of a basket-shaped anode chamber which can be employed in the present invention.
Figure 12:
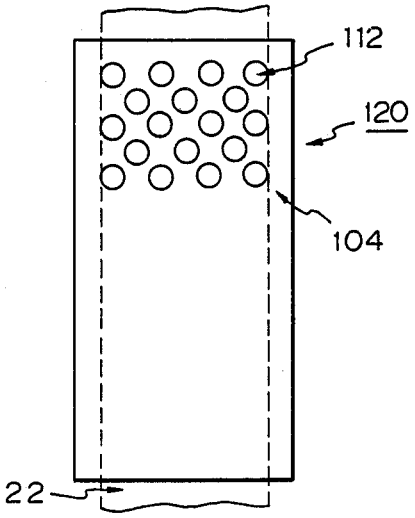
FIG. 12 is a front view of the anode chamber of FIG. 11.

FIG. 11 is a schematic cross-sectional view and FIG. 12 is a schematic front view of a basket-shaped anode chamber 120 in accordance with this embodiment. As shown in these figures, a plurality of pellet-shaped metal bodies 100 are contained within a housing 102 which confronts a steel strip 22 which serves as a cathode. The outermost surface of the housing 102 which confronts the steel strip 22 is made from a multi-hole panel 104 which is made of a suitable metal such as mild steel, nickel, or a nickel alloy. It is covered by electrically insulation or by a lining 106 which can be applied by so-called ceramic spray coating. A screen 108 is disposed on the opposite side of the panel 104.

The pellet-shaped metal bodies 100 are reduced in size by electrolysis, but they are prevented from falling through the holes in the multi-hole panel 104 by the screen 108, which is mounted on the inner side of the panel 104. The screen 108 can be made of tungsten, molybdenum, glass, a heat-resistant polymer, or a composite of these materials. A corrosion-resistant coating may be further applied atop a screen 108 made of the above materials. Some examples of a heat-resistant polymer are Teflon (trademark of DuPont) and polymides. The other sides of the housing 102 can be coated with an electrically insulating lining 110, or the sides themselves can be formed from an electrical insulator.

In a preferred mode of the present invention, the multi-hole panel 104 is formed of nickel or a nickel alloy, while the screen is made of a ceramic electrical insulator. The use of nickel or a nickel alloy remarkably improves both the strength and the impact resistance of the housing 102.

As ions must pass through the multi-hole panel 104, it has openings 112 formed therein. In FIG. 12, only a few of the openings 112 are illustrated.

The thickness of the multi-hole panel 104, the dimensions and distribution of the openings 112, and the characteristics of the screen 108 such as the type of the mesh and the strength of the screen 108 can be suitably determined by one skilled in the art on the basis of the intended use, and these properties are not herein restricted.

When performing continuous molten salt electroplating using such a basket-shaped anode chamber, the metal bodies 100 will settle as they dissolve. The settling of the metal bodies 100 can be compensated for by adding more metal bodies 100 through a suitable charge port formed in the upper portion of the housing 102.

The degree of corrosion of the housing 104 depends on the composition, the temperature and other characteristics of the molten salt electroplating solution. Therefore, the type and the thickness of the electrically insulating coating should be selected in accordance with the electroplating solution.

The following is a concrete example of suitable characteristics of a multi-hole panel and a screen for use in molten salt electroplating.

Composition of molten salt electroplating solution: $AlCl_3$ - NaCl - KCl

Multi-hole panel: Ni alloy +SiC ceramic coating

Screen: Tungsten mesh (mesh length: 1.0 mm)

It can be seen that a basket-shaped anode chamber having adequate corrosion resistance with respect to a molten salt electroplating solution can be obtained without using expensive metals such as Mo or W except for the mesh of the screen. Therefore, not only are material costs decreased, but continuous molten salt electroplating can be performed for long periods of time.

Figure 13:
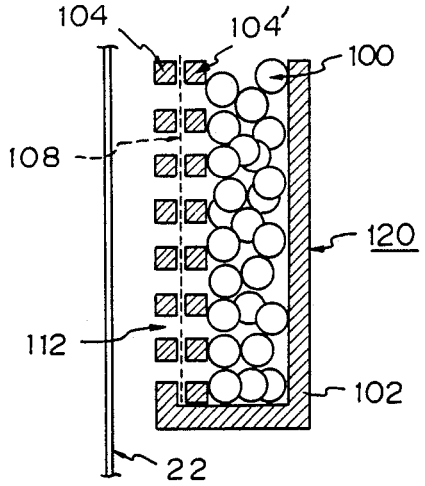
FIG. 13 is a cross-sectional view of a portion of another type of basket-shaped anode chamber for use in the present invention.

FIG. 13 is a schematic cross-sectional view of a portion of another example of a basket-shaped anode chamber in accordance with the present invention. As shown in this figure, pellet-shaped metal bodies 100 which serve as anodes are enclosed in a housing 102 and confront a steel strip 22 which serves as a cathode. The outer surface of the housing 102 which confronts the steel strip 22 is formed from two multi-hole panels 104 and 104', and a screen 108 is sandwiched therebetween. With this double-walled construction, the strength of the housing 120 is increased and the weight of the pellet-shaped metal bodies 100 can be supported more reliably. In particular, the inner multi-hole panel 104' acts as reinforcement for the screen 108.

The basket-shaped anode chamber of the present invention provides great effects in molten salt electroplating, but it can also be effectively employed in aqueous electroplating.

The present inventors found that the corrosion resistance of an electroplating apparatus can be further improved by employing a polyimide for some or all of those parts of the apparatus which are in contact with the molten salt electroplating solution. The parts can be covered with a polyimide layer, or the parts themselves can be made of a polyimide. Some parts for which a polyimide can be employed are all or part of the housing 102, all or part of the multi-hole panel 104, all or part of the inner surface of the electroplating tank 34, and the installation portion for installing the basket-shaped anode chamber on the electroplating tank.

Corrosion resistance can be particularly improved by employing a polyimide which has a molecular structure which does not include an ether linkage, such as polyaminobismaleimide or polyimide 2080.

Figure 14:
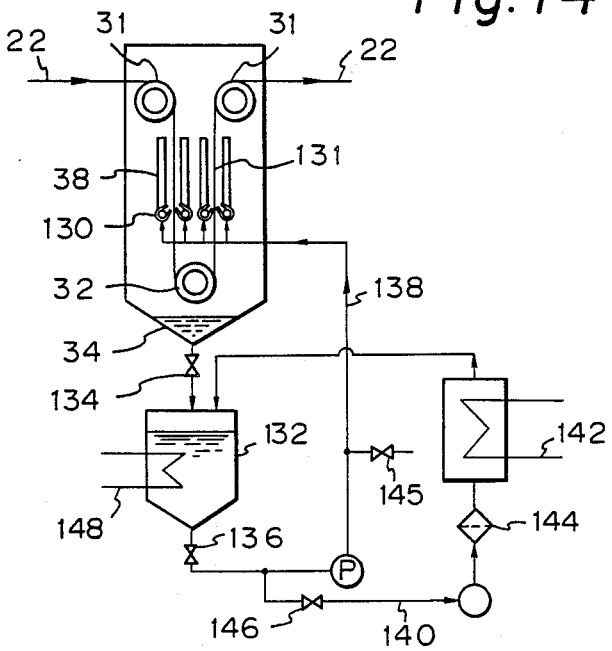
FIG. 14 is a schematic view of a portion of another embodiment of the present invention which has a molten salt electroplating tank which is equipped with unimmersed anodes.

The above-described examples of a basket-shaped anode chamber employ so-called immersed electrodes which are immersed in a molten salt electrodeposition solution. However, the present invention is not restricted to the use of immersed anodes, and FIG. 14 schematically illustrates a portion of another embodiment of the present invention which employs unimmersed anodes. This embodiment is equipped with unimmersed anodes, a storage tank which is disposed below the discharge port of an electroplating tank, and a circulating line for electroplating solution which connects the bottom of the electroplating tank, the storage tank, a pump, the electrodes, and the discharge port of the electroplating tank.

As shown in FIG. 14, after being subjected to activation a steel strip 22 is guided into an electroplating tank 34 by an upper conductor roller 31. The strip 22 passes downwards, is reversed in direction about a lower conductor roller 32, passes upwards, and exits from the electroplating tank 34 over another upper conductor roller 31. A molten salt electroplating solution having a suitable composition and temperature is maintained within a storage tank 132. When valves 134 and 136 are open, this electroplating solution is supplied via a pump P and a circulating line 138 to electroplating zones 131. Each electroplating zone 131 is defined by a pair of anodes 38 which are hung within the electroplating tank 34 in a confronting relationship with the steel strip 22 and by nozzles 130. The electroplating zones 131 are filled with the electroplating solution, and if the conductor rollers 31 and the anodes 38 are connected to the cathode and the anode, respectively, of an unillustrated direct current power supply, an electric circuit will be formed through which current will flow, and the steel strip will be electroplated in accordance with the electric charge passing through the circuit.

Although not shown in detail in FIG. 14, most of the electroplating solution which is supplied to the electroplating zones 131 flows upwards within the electroplating zones 131 from the bottom thereof, overflows the zones 131, and then flows downwards to the bottom of the electroplating tank 34. Unillustrated side plates which are connected to the anodes 38 are provided on both sides of each zone 131 so as to enclose the steel strip 22 from its sides. The nozzles 130 are disposed at the bottom portions of the zones 131 so as to minimize the leakage of electroplating solution through the bottom portions.

When valve 134 is open, the electroplating solution which flows to the bottom of the electroplating tank 34 flows down into the storage tank 132 and accumulates there. From the storage tank 132, it is again transported to the electroplating zones 131 by the pump P. The rate at which the electroplating solution is supplied to the electroplating zones 131 must be large enough for the electroplating solution to maintain the electroplating zones 131 at a suitable temperature by removing Joule heat which is generated by the electroplating solution and the steel strip 22 in the electroplating zones 131, it must be large enough to supply the necessary amount of ions of the metal to be plated to the surface of the steel strip 22, and it must be large enough to create an adequate flow velocity within the electroplating zones 131.

Between valve 136 and the pump P of FIG. 14, a branch line 140 branches from the circulating line 138. A cooling unit 142 is installed along this branch line 140. As sludge accumulates in the electroplating liquid, a strainer 144 is also installed along the branch line 140. After passing through the strainer 144 and the cooling unit 142, the electroplating solution in the branch line 140 is returned to the storage tank 132 together with an additional electroplating solution from a supply line (not shown) to make up for any depletion of the electroplating solution in the storage tank 132. A discharge valve 145 for removing waste matter from the storage tank 132 is left open. At the startup time of the embodiment of FIG. 14, a salt is charged into the storage tank 132 and is melted by a heater 148. The heater 148 then heats the molten salt to a prescribed temperature to prepare an electroplating solution.

In the embodiment of FIG. 14, the nozzles 130 are disposed at the bottom of the unimmersed anodes 38, and electroplating solution flows up through the electroplating zones 131 and overflows the upper ends thereof. However, it is also possible to dispose the nozzles 130 above the unimmersed anodes 38, to provide a suitable gap between the lower ends of the anodes 38 and the steel strip 22, and to have the electroplating solution flow downwards from the top to the bottom of the electroplating zones 131 due to gravity.

The above-described continuous molten salt electroplating apparatus having unimmersed anodes provides the following advantages.

(1) When it is necessary to stop the apparatus to investigate problems or perform repairs, the electroplating solution can be rapidly drained from the electroplating tank (2) Current can be supplied to the steel strip 22 through the conductor roller 32 which is disposed at the bottom of the electroplating tank 34. Accordingly, the current supply path has low resistance, and the required voltage and electrical power can be decreased. The amount of waste heating of conducting parts is also reduced.

(3) As the conductor roller 32 at the bottom of the electroplating tank 34 is not immersed in the electroplating solution, the electroplating solution does not penetrate to the bearings of the roller 32, nor does it leak to the outside of the electroplating tank 34. Therefore, the structure of a shaft seal for the conductor roller 32 can be simplified.

(4) Heating, melting, and cooling of the salt and adjusting the composition of the electroplating solution are performed outside the electroplating tank 34. Therefore, the structure of the electroplating tank 34 is simplified, and problems which are caused by an electroplating tank having a complicated structure can be greatly reduced. Furthermore, as an electroplating solution having a suitable temperature and a suitable composition is supplied to the electroplating zones, electroplating can be performed more stably.

Next, the present invention will be further described by means of the following examples.

EXAMPLE 1

In order to simulate the electroplating method of the present invention using the apparatus illustrated in FIG. 2, an electroplating tank for a molten salt bath was prepared using SUS316L stainless steel. Anodes made of 99.8%-pure A1 plates were disposed in the electroplating tank. SPCD-class mild steel strip with a thickness of 0.8 mm was used as a steel member for electroplating. Electroplating was performed in a molten salt electroplating solution under the conditions shown in Table 1.

TABLE 1

| | |
|---|---|
| Solution Composition | $AlCl_3$ 62 mole %, NaCl 20 mole % KCl 18 mole %, $MnCl_2$ 3000 ppm |
| Solution Temperature | 210° C. |
| Solution Flow Speed | 0.6 m/s |
| Electrical Charge | 1200 Coulombs/dm$^2$ Current density: 60 A/dm$^2$ |

Figure 15:
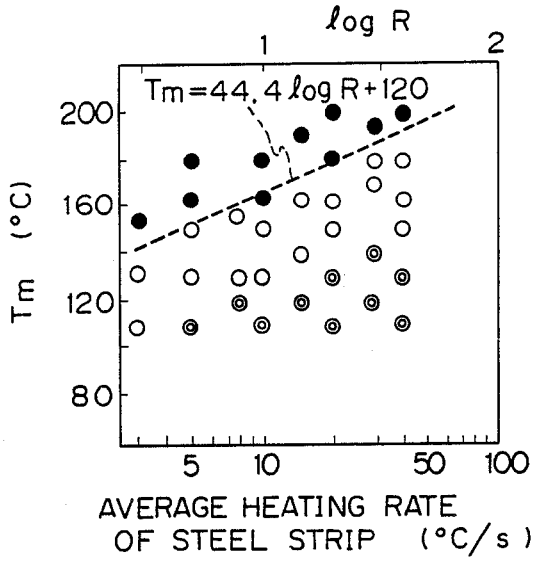
FIG. 15 through 18 are graphs showing the results of tests performed on steel members which were electroplated in accordance with the present invention.

Pretreatment of the steel strip to be plated consisted first of electrolytic cleaning. The steel strip was placed in a 5% sodium orthosilicate solution, and with the steel strip functioning as an anode, electrolytic cleaning was performed at a current density of 10 A/dm$^2$ for 15 seconds. The strip was then washed in water, after which acid washing in a 10% HC1 aqueous solution was performed for 20 seconds. After this pretreatment, the steel strip was again washed with water in a water washing step, and then most of the water film on the steel strip was removed with air at room temperature using an air blower. The steel strip was then quickly placed in an infrared heater whose rate of temperature increase and maximum heating temperature were set in advance, and the steel strip was heated in air. After heating, the heater was filled with $N_2$ gas and the steel strip was quickly cooled at a rate of 30° C./sec The steel strip was maintained at the maximum temperature in the infrared heater for 0 seconds. The steel strip was then removed from the infrared heater and electroplating was performed by the above-described method. However, prior to electroplating, anodic treatment was performed in an electroplating solution with the steel strip functioning as an anode at a current density of 10 A/dm$^2$ for 2 seconds and at 25 A/dm$^2$ for 2 seconds. After electroplating, the steel strip was washed with water, dried, and then the adhesion of the plating was evaluated by the Dupont impact test (tip diameter of tester: ½ inch, potential energy: 0.8 kgf-m). The results are graphed in FIG. 15, in which the symbol "o" indicates cases wherein anodic treatment was performed at 10 A/dm$^2$ for 2 seconds and plating adhesion was satisfactory, the symbol "o" indicates cases wherein anodic treatment was performed at 25 A/dm$^2$ for 2 seconds and plating adhesion was satisfactory, and the symbol "o" indicates cases wherein anodic treatment was performed at 25 A/dm$^2$ for 2 seconds and plating adhesion was unsatisfactory.

When the maximum temperature reached by the steel strip exceeded 100° C. and the condition $Tm \leqq (44.4)\log R + 120$ was satisfied, it was found that the surface of the steel strip being treated could be activated by anodic treatment lasting for 2 seconds or less.

EXAMPLE 2

The method of Example 1 was substantially repeated, but the rate of heating and the maximum heating temperature of a steel strip were varied to investigate the effects of these parameters on the adhesion of plating. For each rate of heating, the maximum allowable heating temperature was determined.

Figure 16:
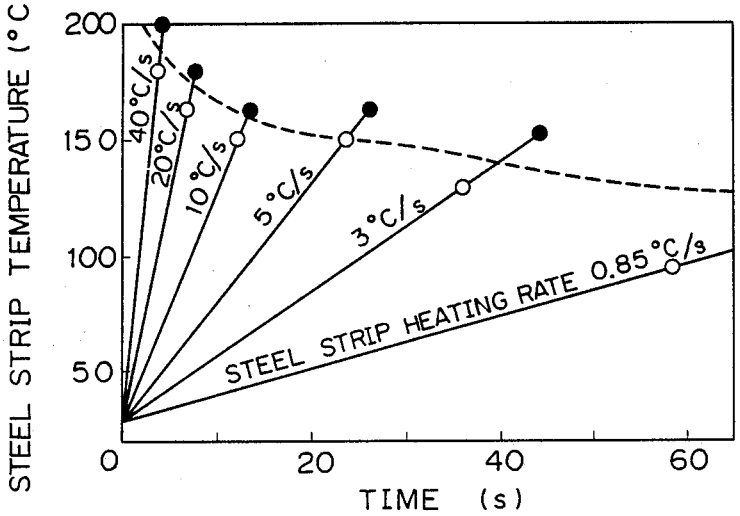

The results are graphed in FIG. 16. The solid circles indicate cases in which the adhesion of the plating was unsatisfactory, and the open circles indicate cases in which the plating adhesion was satisfactory. For all cases, anodic treatment was performed at 25 A/dm$^2$ for 2 seconds. The ordinate of each circle indicates the temperature at which the temperature increase was halted. In the region above the dashed line in the figure, heating must be performed in an inert gas atmosphere, whereas in the region below the dashed line, heating in air is possible.

It can be seen from this figure that when the rate of temperature increase is high, the maximum heating temperature can be correspondingly high, and when the rate of temperature increase is low, the maximum heating temperature must be restricted to a lower level. Accordingly, if a high rate of heating is employed, it is not necessary to perform preheating in an inactive gas atmosphere, and anodic treatment can be performed on a steel member which has been dried by heating in air.

EXAMPLE 3

The method of Example 1 was repeated. The electroplating conditions are shown in Table 2.

TABLE 2

| | |
|---|---|
| Solution Composition | $AlCl_3$ 62 mole %, NaCl 20 mole % KCl 18 mole % |
| Solution Temperature | 210° C. |
| Solution Flow Speed | 0.6 m/s |
| Electrical Charge | 2400 Coulombs/dm$^2$ Current density: 40 A/dm$^2$ |

Steel strips were pretreated by first subjecting them to electrolytic cleaning. The steel strips were placed in a 5% sodium orthosilicate solution, and with the steel strips functioning as anodes, electrolytic cleaning was performed at 10 A/dm$^2$ for 15 seconds. The strips were then washed with water, then washed in a 10% HC1 aqueous solution for 20 seconds, and then again washed with water. The strips were next placed in a drier which was set at 180–200° C. and dried for 30 seconds (air speed: 10 m/sec). After drying, the inside of the drier was quickly filled with $N_2$ gas and the strips were cooled. They were then removed from the drier and placed into an anodic treatment tank. Anodic treatment with the strips serving as anodes was performed for 2 seconds under the conditions shown in Table 3, after which molten salt electroplating was performed in the manner described above.

TABLE 3

| | |
|---|---|
| Flow Speed | 0.3 m/s |
| Electrical Charge | 40 Coulombs/dm$^2$ Current density: 20 A/dm$^2$ |

After electroplating, the steel strips were washed with water, dried, and then the adhesion of the plating was evaluated by the Dupont impact test (diameter of tip of tester: ½ inch, potential energy: 0.8 kgf-m). The results are shown in Table 4.

When using a 3-component anodic treatment solution, at 200° C., there was no electrodeposition during anodic treatment when the proportion of A1C1$_3$ was 50–54 mole %. However, with a proportion of less than 50 mole %, a solid phase appeared and the electrolysis voltage increased. Electrodeposition was experienced when the counter electrode was made of stainless steel or iron.

TABLE 4

| No. | Solution Composition (mole %) $AlCl_3$ | NaCl | KCl | Solution Temp. (°C.) | Adhesion* | Counter Electrode Material | Electrodeposition on Counter Electrode** | Comments |
|---|---|---|---|---|---|---|---|---|
| 1 | 50 | 33 | 17 | 200 | O | Al | None | |
| 2 | 51 | 32 | 17 | 200 | O | Al | None | Present Invention |
| 3 | 52 | 32 | 16 | 200 | O | Al | None | |
| 4 | 53 | 31 | 16 | 200 | O | Al | None | |
| 5 | 54 | 31 | 15 | 200 | O | Al | None | |
| 6 | 55 | 30 | 15 | 200 | O | Al | On portions | Comparative Example |
| 7 | 56 | 30 | 14 | 200 | O | Al | Yes | |
| 8 | 53 | 31 | 16 | 180 | O | Al | None | Present Invention |
| 9 | 53 | 31 | 16 | 180 | O | Ti | None | |
| 10 | 53 | 31 | 16 | 180 | O | SUS304 | On portions | Comparative Example |
| 11 | 53 | 31 | 16 | 180 | O | Fe | Yes | |

Notes:
*Tape peeling after Dupont impact test
O No Peeling
**Performed in anodic treatment tank
SUS304: Austenitic stainless steel (Japanese Industrial Standards)

EXAMPLE 4

The method of Example 3 was substantially repeated with the exception that the heating temperature of steel strips in the drying step was varied from 20°–180° C. and anodic treatment was performed at 30 A/dm$^2$ for 0–10 seconds.

Figure 17:
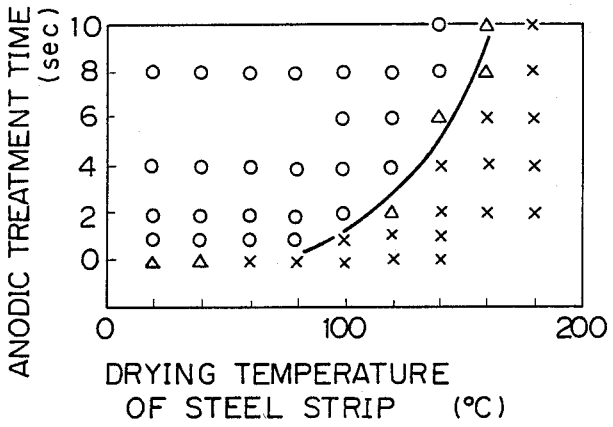

The adhesion of the resulting Al plating was evaluated in the same manner as in Example 3. The results are graphed in FIG. 17, in which the symbol "o" indicates cases wherein plating adhesion is satisfactory, the symbol "Δ" indicates cases wherein plating adhesion is fair, and the symbol "X" indicates cases wherein plating adhesion is unsatisfactory.

As is clear from the results, excessive drying of the steel strips prior to electroplating can result in poor plating adhesion, and the effects of drying increase as the drying temperature increases. However, anodic treatment performed in accordance with the present invention can solve the problems caused by drying.

EXAMPLE 5

In this example, the amount of electrodeposition on the counter electrode during anodic treatment was investigated when using a 2-component $AlCl_3$-NaCl treatment solution. The method of Example 3 was repeated with the exception that the composition and temperature of the anodic treatment solution were varied. A 99.5%-pure Al sheet was used as a counter electrode, the current density was 20 A/dm$^2$, and the flow speed was 0.3 m/sec.

Figure 18:
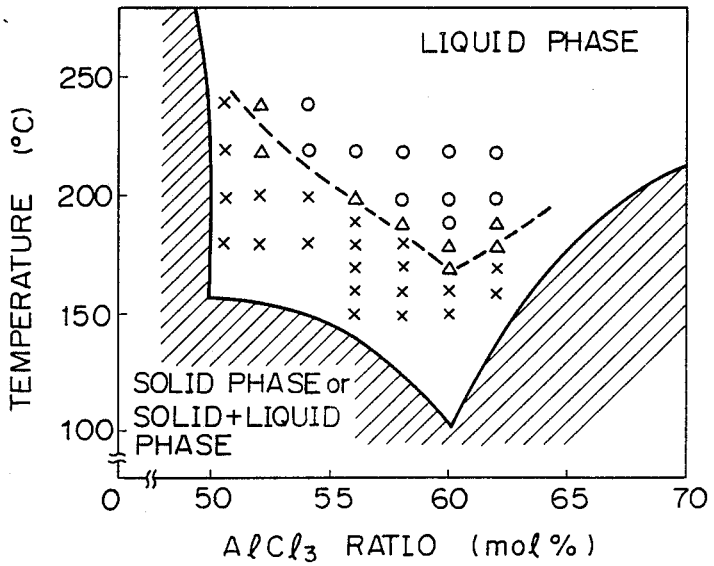

The results are graphed in FIG. 18. It can be seen that in the region in which the temperature of the treatment solution was at most 70° C. above the melting point (indicated by the solid line), there was almost no electrodeposition on the counter electrode.

What is claimed is:

1. A molten salt electroplating apparatus comprising:
means for drying and preheating a previously cleaned steel member;
anodic treatment means for activating the surface of said steel member after it has been preheated;
iron ion removing means connected to said anodic treatment means and containing a packed layer of metal particles having a greater tendency to ionize than iron;
and electroplating means including an electroplating zone defined by an unimmersed anode and said steel member and further including a means for introducing a molten salt into said electroplating zone wherein said steel member is electroplated in said electroplating zone after its surface has been activated.

2. An electroplating apparatus as claimed in claim 1, further comprising means for circulating a molten salt electroplating solution between said electroplating zone and a bottom portion of an electroplating tank in which said electroplating solution which is sprayed into said electroplating zone accumulates.

3. An electroplating apparatus as claimed in claim 1, wherein said unimmersed anode is a basket-shaped anode comprising a housing which contains metal bodies selected from among granular metal bodies and pellet-shaped metal bodies which serve as anodes, said housing having a multi-hole panel on the side thereof which confronts a cathode and having a screen which is disposed on the inside of said panel, wherein at least said multi-hold panel of said housing being made of a material selected from among an electrical insulator and a metal which is coated with an electrical insulator.

4. An electroplating apparatus as claimed in claim 3, wherein said screen is made of a material selected from among tungsten, molybdenum, glass, heat-resistant polymers, and composites thereof.

5. An electroplating apparatus as claimed in claim 3, wherein said electrical insulator is a ceramic.

6. An electroplating apparatus as claimed in claim 1, wherein said unimmersed anode is a basket-shaped anode comprising a housing which contains metal bodies selected from among granular metal bodies and pellet-shaped metal bodies which serves as anodes, said housing having two multi-hole panels on the side thereof which confronts a cathode, a screen being sandwiched between said multi-hole panels.

7. An electroplating apparatus as claimed in claim 6, wherein said screen is made from a material selected from among Mo and W.

8. An electroplating apparatus as claimed in claim 6, wherein at least the one of said two multi-hole panels which is closer to said cathode is made of a material selected from among an electrical insulator and a metal which is covered with an electrical insulator.

9. An electroplating apparatus as claimed in claim 1, wherein at least some of the portions which contact a molten salt electroplating solution employ a polyimide.

10. An electroplating apparatus as claimed in claim 9, wherein said unimmersed anode is a basket-shaped anode comprising a housing which contains metal bodies selected from among granular metal bodies and pellet-shaped metal bodies which serve as anodes, the side of said housing which confronts an anode being formed by a multi-hole panel, said panel having a screen provided on the inside thereof, said apparatus further comprising an electroplating tank in which said anode is disposed without being immersed in an electroplating solution, at least part of one of said housing, said multi-hole panel, the inside surface of said electroplating tank, and a portion where said anode is connected to said electroplating tank employing a polyimide.

* * * * *

UNITED STATES PATENT AND TRADEMARK OFFICE

CERTIFICATE OF CORRECTION

PATENT NO. : 4,895,633

DATED : January 23, 1990

INVENTOR(S) : Hirohisa SETO, et al.

It is certified that error appears in the above-identified patent and that said Letters Patent is hereby corrected as shown below:

On the title page:

[75] Inventors: Name of ninth inventor should be --Katsufumi HIDAKA--

Signed and Sealed this

Twenty-second Day of January, 1991

*Attest:*

HARRY F. MANBECK, JR.

*Attesting Officer*

*Commissioner of Patents and Trademarks*